United States Patent [19]

Fisher

[11] 4,055,335

[45] Oct. 25, 1977

[54] TRANSFORMATION OF TOP-BLOWN STEEL CONVERTER VESSEL TO BOTTOM-BLOWN TYPE

[75] Inventor: Howard M. Fisher, New Castle, Pa.

[73] Assignee: Pennsylvania Engineering Corporation, Pittsburgh, Pa.

[21] Appl. No.: 438,586

[22] Filed: Feb. 1, 1974

Related U.S. Application Data

[62] Division of Ser. No. 261,823, June 12, 1972, Pat. No. 3,810,297.

[51] Int. Cl.[2] ..... C21C 5/46; C21C 5/50

[52] U.S. Cl. ..... 266/245; 266/266; 266/270

[58] Field of Search ..... 75/60; 266/35, 36 P, 266/243, 245, 266, 270

[56] References Cited

U.S. PATENT DOCUMENTS

| | | | |
|---|---|---|---|
| 2,325,464 | 7/1943 | Bannister | 285/22 |
| 2,333,654 | 11/1943 | Lellep | 75/60 |
| 2,641,461 | 6/1953 | Lewis | 266/36 P |
| 3,373,985 | 3/1968 | Puxkandl | 266/36 P |
| 3,795,389 | 3/1974 | Kennedy | 266/36 P |

FOREIGN PATENT DOCUMENTS

| | | | |
|---|---|---|---|
| 1,166,800 | 5/1964 | Germany | 266/36 |
| 812,258 | 5/1959 | United Kingdom | 266/36 |
| 891,547 | 3/1962 | United Kingdom | 266/36 |

*Primary Examiner*—Roy Lake
*Assistant Examiner*—Paul A. Bell
*Attorney, Agent, or Firm*—Fred Wiviott

[57] ABSTRACT

An existing basic oxygen type top-blown steel converter vessel is transformed into a bottom-blown type where gases and finely divided materials may be blown into the vessel through tuyeres in its side wall and in its bottom. The existing trunnion shafts on which the existing vessel is supported for tilting are bored at the installation site to provide a plurality of passageways for conducting finely divided materials, gases and cooling water to the various tuyeres and to the trunnion ring which supports the vessel, respectively. Special multipurpose rotary joints are used to connect the tiltable vessel to sources of the gases and finely divided materials.

2 Claims, 10 Drawing Figures

TRANSFORMATION OF TOP-BLOWN STEEL CONVERTER VESSEL TO BOTTOM-BLOWN TYPE

This is a division, of application Ser. No. 261,823, filed June 12, 1972 now U.S. Pat. No. 3,810,297.

BACKGROUND OF THE INVENTION

In the conventional basic oxygen method for converting molten pig iron to steel a quantity of molten metal is contained in a refractory lined vessel and oxygen is injected directly into the surface of the molten metal by means of a lance which is admitted through the mouth of the vessel while it is upright. The vessel is usually supported in a trunnion ring from which diametrically opposite trunnion pins extend into bearings which facilitate tilting the vessel for the purposes of charging it with raw materials and for discharging its contents through its mouth. There is usually a hood above the mouth of the vessel when it is in its upright position for the purpose of collecting gases which evolve incidental to the steel refining process. When it is desired to charge the vessel with hot metal, scrap and slag producing and fluxing agents such as burnt lime, the vessel mouth must be tilted away from the hood or the hood must be shifted to provide access to the vessel. Large quantities of smoke and noxious gases evolve from the vessel into the atmosphere when the vessel and gas collection hood are separated. Even when the hood is close to the vessel mouth as it is during vessel operation, significant quantities of smoke and gases still escape to the atmosphere. This is a major source of pollution which has resulted in threats to shut plants down until antipollution regulations can be met.

Bottom blown oxygen converter vessels have become known recently. In this type of vessel oxygen and finely divided fluxing materials are injected primarily beneath the surface of the molten metal within the vessel through tuyeres in the bottom and sides of the vessel. By injecting oxygen, other gases and finely divided solids entrained in gases through the bottom tuyeres, the constituents of the molten metal, such as the carbon which is to be reduced by oxygen, are in intimate contact with the gases and solids that permeate the melt. This results in more nearly stoichiometric chemical reactions and there is an accompanying reduction of smoke. Moreover, it is possible to keep the hood very close to the vessel mouth so that only insignificant quantities of gas and smoke can escape to the atmosphere.

SUMMARY OF THE INVENTION

The present invention is concerned with overcoming the above outlined pollution problems associated with operation of top-blown basic oxygen converter vessels. An important object of this invention is to accomplish transformation of existing top-blown converter vessels into bottom-blown vessels at the installation site of the top-blown vessel.

Other important objects of this invention are to disclose a method and means for transforming top-blown converter vessels to the bottom-blown type so that they can meet antipollution requirements and realize other advantages such as a more economical operation.

Still another object of this invention is to save an investment in capital equipment which might be lost as a result of having to retire a relatively new converter top-blown vessel because of its inherent inability to be operated in compliance with antipollution regulations.

In accordance with the invention, as installed top-blown basic oxygen converter vessel is transformed into a bottom-blown type at the installation site. In general terms this is accomplished by installing tuyeres in the previously imperforate bottom of the existing converter vessel. The trunnion shafts on which the vessel is supported are suitably bored to provide passageways for conducting gases and entrained finely divided materials to the bottom tuyeres. Passageways are also provided for conducting gases to tuyeres in the sidewalls of the vessel and for conducting cooling water to and from the trunnion ring which supports the vessel. Special rotary joints are provided for interconnecting the trunnion shaft passageways to the stationary piping which leads back to the sources of the gases and other materials.

How the above general objects and other more specific objects are achieved will appear in the course of the more detailed description of preferred embodiments of the new method and apparatus which will be set forth shortly hereinafter in reference to the drawings.

DESCRIPTION OF A PREFERRED EMBODIMENT

Figure 1:
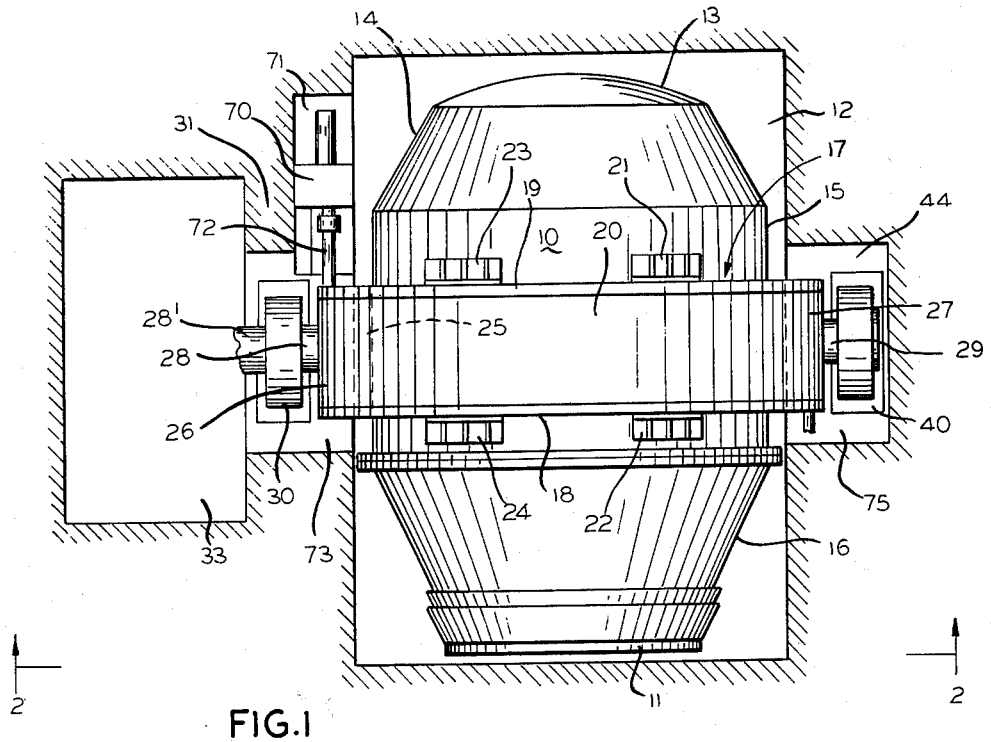
FIG. 1 is a plan view of a converter vessel that is rotated 90° from its normal operating position, parts of the vessel being broken away, and the vessel being associated with a temporarily installed boring machine which is used to provide passageways in the vessel trunnion ring and trunnion pins for communicating the vessel tuyeres with fluidic material sources.
Figure 2:
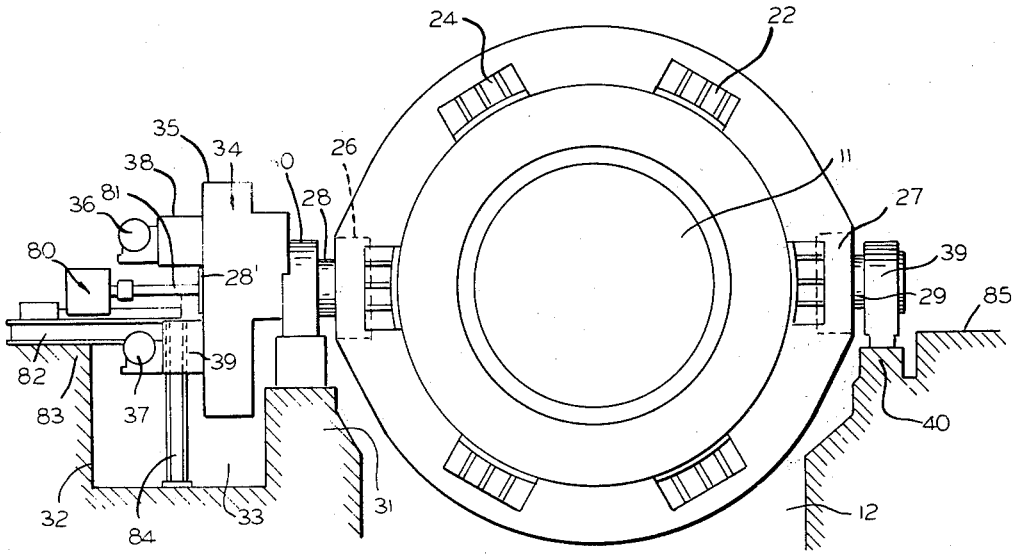
FIG. 2 is a side elevation of the vessel rotated 90° from its operating position in conjunction with the boring machine which is used to make trunnion pin passageways for transforming a top-blown vessel to a bottom-blown type.

In FIG. 1 a conventional top-blown converter vessel 10 is shown in one of the positions which it assumes during transformation of it to a bottom-blown type of converter vessel. When the vessel 10 is in its operating position, the mouth 11 of the vessel which can be seen in FIG. 2 is presented upwardly. In other words, vessel 10 is rotated 90° on a horizontal axis, from the position in which it appears in FIG. 1, during normal operation. Vessel 10 is in a concrete walled pit 12 which is deep enough to allow the vessel to rotate through a full circle on its horizontal axis. Conventional top-blown converter vessels have an imperforate bottom section 13 defined by a metal shell 14. The bottom shell 14 and the cylindrical metal midsection shell 15 together with the conical upper shell section 16 are all lined with refractory material, not shown, in a well known fashion.

Vessel 10 is supported in a trunnion ring 17 which has upper 18 and lower 19 flanges that are joined by an internal axially extending substantially circular web and an external web such as 20. Thus, in effect, trunnion ring 17 is a circular beam in which there are circumferential passageways through which cooling water may be circulated if desired. Vessel 10 is supported on the flanges 18 and 19 of trunnion ring 17 by means of a plurality of upper and lower circumferentially spaced brackets such as those marked 21–24 or any other means of suspension which prevents the vessel from separating from the ring when the vessel is either upright or inverted. There is an annular gap 25 between the trunnion ring 17 and vessel 10 to allow for expansion and distortion of the vessel which inevitably occurs when it is alternately heated and cooled.

At the sides and internally of the trunnion ring 17 there are built-in supporting blocks 26 and 27 in which opposite horizontally extending trunnion shafts or pins 28 and 29 are affixed. Trunnion pin 28 is journaled in a bearing structure 30 as can be seen in FIGS. 1 and 2, and the pin 28 extends through the bearing structure 30 as indicated by the broken away portion 28' in FIG. 1. The bearing structure 30 is supported on a concrete pier 31 which together with another concrete wall 32 defines a pit 33. The pit accommodates a vessel drive mechanism 34 which is omitted from FIG. 1 but appears in elevation in FIG. 2. For convenience, the side of the vessel on which drive mechanism 34 is situated will hereinafter be called the drive side. The drive mechanism 34 is conventional and need not be described in detail except to say that it comprises a housing 35 which is journaled on trunnion pin 28 and is prevented from rotating by means which have been omitted from the drawings. Mounted on housing 35 are several electric or hydraulic drive motors such as motors 36 and 37 which are connected to speed reducers 38 and 39, respectively, which are also supported from housing 35. Extending from the speed reducers are drive shafts, not shown, which have pinions, not shown, on their ends. The pinions engage with a bull gear, not shown, which is keyed to trunnion pin 28. Thus, when motors such as 36 are operated, the bull gear and trunnion pin 28 are driven and the vessel 10 is caused to tilt about the horizontal axis of trunnion pins 28 and 29. It should be noted in FIG. 2 that the end 28' of trunnion pin 28 extends through gear housing 35 so as to be accessible for boring passageways in it in accordance with the invention.

The trunnion pin 29 on the other side of the vessel 10, hereafter called the idler side, is also journaled in a bearing structure 39 which is supported on a concrete pier 40 at the perimeter of the pit 12 in which the vessel is located.

Figure 3:
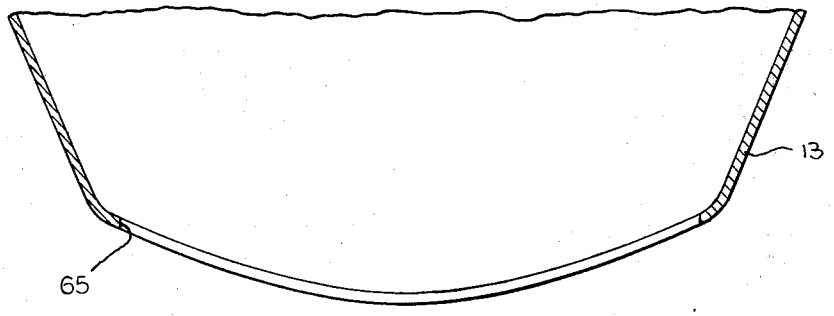
FIG. 3 is a fragmentary elevational section of the bottom portion of a converter vessel shell.
Figure 4:
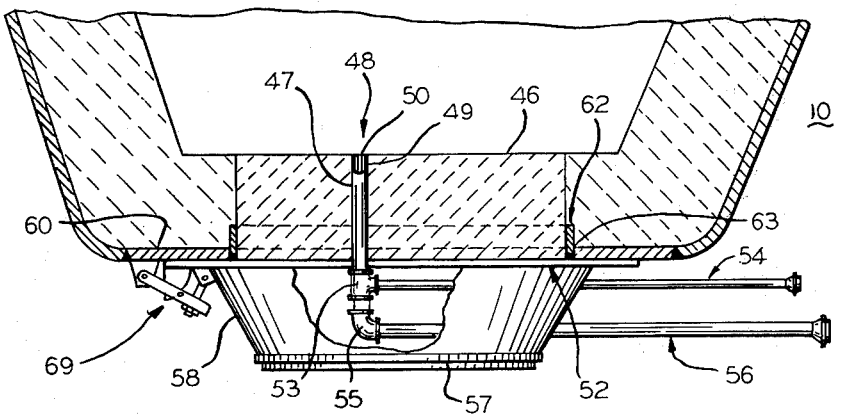
FIG. 4 is a fragmentary view of the bottom portion of a converter vessel which has been transformed in accordance with the invention and is associated with a modified outer vessel shell which is shown fragmentarily and in section.
Figure 5:
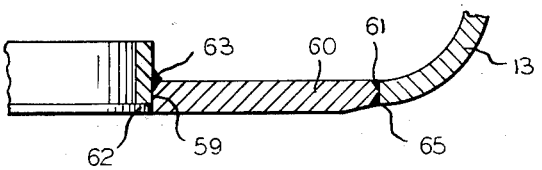
FIG. 5 is an enlarged view of a portion of the shell shown in the preceding figure.

As mentioned earlier, the invention involves a method and apparatus for placing the tuyeres of a tiltable converter vessel in communication with stationary sources of fluidic materials such as gases, finely divided materials and cooling water so that the vessel may be operated as a bottom-blown vessel instead of as a top-blown vessel for which it was originally designed. Shortly hereinafter a detailed description of the method for transforming the vessel into a bottom-blown type will be given, but before that, the construction and operating mode of the tuyeres which are installed in the vessel bottom will be described in reference to FIGS. 3, 4 and 5. FIG. 4 shows the bottom portion of a converter vessel 10 which has been transformed from a top-blown type to a bottom-blown type. As mentioned earlier, the interior vessel bottom is lined with refractory material 46 which is originally imperforate in a top-blown vessel.

To make the bottom-blown transformation, the refractory lining inside the vessel is removed. The spherical head 13 in the bottom of the vessel is flame cut along the circular periphery 65 as shown in FIG. 3. A circular plate 60, FIG. 5, with a concentric circular cut-out in its middle is welded along periphery 65 by welds 61. Circular plate 60 is prepared with a reinforcing ring 62 inserted and welded along the periphery of the circular cut-out at 63. Another circular plate 52, FIG. 4, of suitable diameter and thickness is prepared to fit over the cut-out bottom of the vessel, from the outside to close the opening described before. Circular plate 52 is bored with axially or inclined extending holes 67. Several tuyeres such as 48 are then installed in a predetermined pattern in the bottom of the vessel, although only one tuyere 48 is shown in FIG. 4. The tuyere is sealed in the refractory bottom 46. These tuyeres 48 comprise two concentric pipes which have a small annular gap between them. The outer pipe is marked 49 and the inner pipe is marked 50 in FIG. 4. The outer pipe is connected by means of a flange 51 to the bottom plate 52. A means is provided to connect the annular gap between outer pipe 49 and inner pipe 50 so that gas may be conducted axially of the small gap and into the molten metal which is supported on refractory bottom 46 added to plate 52. Typically a header, not shown, is used in place of individual tees such as 53 and the header is supplied with pressurized gas by means of a pipe such as 54. The central pipe 50 extends through tee 53 and connects by some means such as elbow 55 to a distributor device connected to pipe 56 which is typically larger than pipe 54.

In connection with the bottom-blown process, pressurized gases such as oxygen and oxygen which entrains finely divided fluxing material such as burnt lime are delivered through pipe 56 to inner tuyere pipe 50 so that these fluidic materials may be injected directly into the molten metal within vessel 10. As is known, the oxygen is let to react with the undesirable impurities such as sulphur, phosphorous, excessive carbon and other elements to form oxides including carbon monoxide and then carbon dioxide which evolve from the vessel mouth and into the gas collection hood and the fluxing agents react with other constituents of the melt to form slag which accumulates on the top of the melt. The reaction between oxygen and the impurities is an exothermic reaction which causes intense heat in the vicinity of the tuyere pipe tips. Thus it is necessary to cool the tuyere tips and surrounding refractory bottom material 46 to avoid having the tuyeres and refractory burn away prematurely. This is accomplished by injecting a hydrocarbon gas such as propane through the annular gap between outside tuyere pipe 49 and inside tuyere pipe 50. When the hydrocarbon gas is subjected to the intense heat of the molten metal in the vicinity of the tuyeres the gas cracks into its hydrogen and carbon components. This is an endothermic process which effectuates cooling of the tuyeres and surrounding refractory material. As a result, several hundred heats of molten metal can be refined in vessel 10 before replacement of the tuyeres and refractory bottom is necessary.

As shown in FIG. 4, the transformation of the converter vessel 10 from a top-blown type to a bottom-blown type requires providing an access opening 57 in the casing 58 which surrounds the gas connections to the tuyeres 48. Opening 57 may be provided with a removable bottom flange plate for access. Casing 58 is secured to the vessel shell with several clamping devices 69.

Because vessel 10 is tiltable, it is necessary to provide suitable passageways in the drive side trunnion pin 28 and the idler side trunnion pin 29 to communicate the bottom tuyeres 48 and also side wall tuyeres to be discussed later with stationary pipes that connect to fluidic material, not shown, sources by way of rotary joints, to be discussed, which fasten to the ends of the drive side trunnion pin 28 and idler side trunnion pin 29. The method of making the passageways and, hence, carrying on necessary step for transforming a top-blown vessel into a bottom-blown type will now be discussed primarily in reference to FIGS. 1 and 2. Both axial and radial passageways or bores are required in trunnion pins 28 and 29 and radial bores are variously required in the trunnion pins and trunnion ring side blocks 26 and 27. The use of these bores in typical cases will be discussed later in connection with FIGS. 7 and 9 primarily. For the present, attention is directed to FIGS. 1 and 2 for a discussion of the method and apparatus required for making the bores.

In FIG. 1 a boring machine 70 is temporarily installed in a pit 71 and is set up for making the bore in trunnion block 26 and drive side trunnion pin 28 in a direction which is radial with respect to the axis of trunnion pin 28. It will be explained later how a suitable opening is made in trunnion ring flange 19 to permit access by the spindle 72 of boring machine 70. Spindle 72, is, of course, adapted at its outer end to hold a drill, not shown, for making a pilot hole and for holding a cutting bit, not shown, for making one or more bores of suitable size.

Other radial bores may be and usually are made by setting up boring machine 70 in other locations such as are marked with the reference numerals 73, 74 and 75. The last two locations 74 and 75 are for making bores as required in trunnion block 27 and trunnion pin 29 on the idler side.

FIG. 2 demonstrates use of a boring machine 80 for making a bore endwise of drive side trunnion pin 28. The spindle 81 of boring machine 80 extends into the end 28' of the idler trunnion pin which projects through the drive mechanism gear housing 35. Boring machine 80 is supported on suitable beams 82 which are temporarily fastened to concrete operating floor 83. The boring machine base 82 is further supported and stabilized by a temporarily installed support column 84 which rests on the concrete bottom of pit 33. The boring machine 80 is also transferred with its base 82 for being supported on concrete floor 85 adjacent idler trunnion pin 29 whose end is exposed through bearing structure 39 so as to be accessible by the spindle 81 of boring machine 80. Thus, with the various setups that are obtainable in FIG. 2 axial bores may be made in trunnion pins 28 and 29 and these bores may be extended into trunnion ring side blocks 26 and 27 as required.

Figure 6:
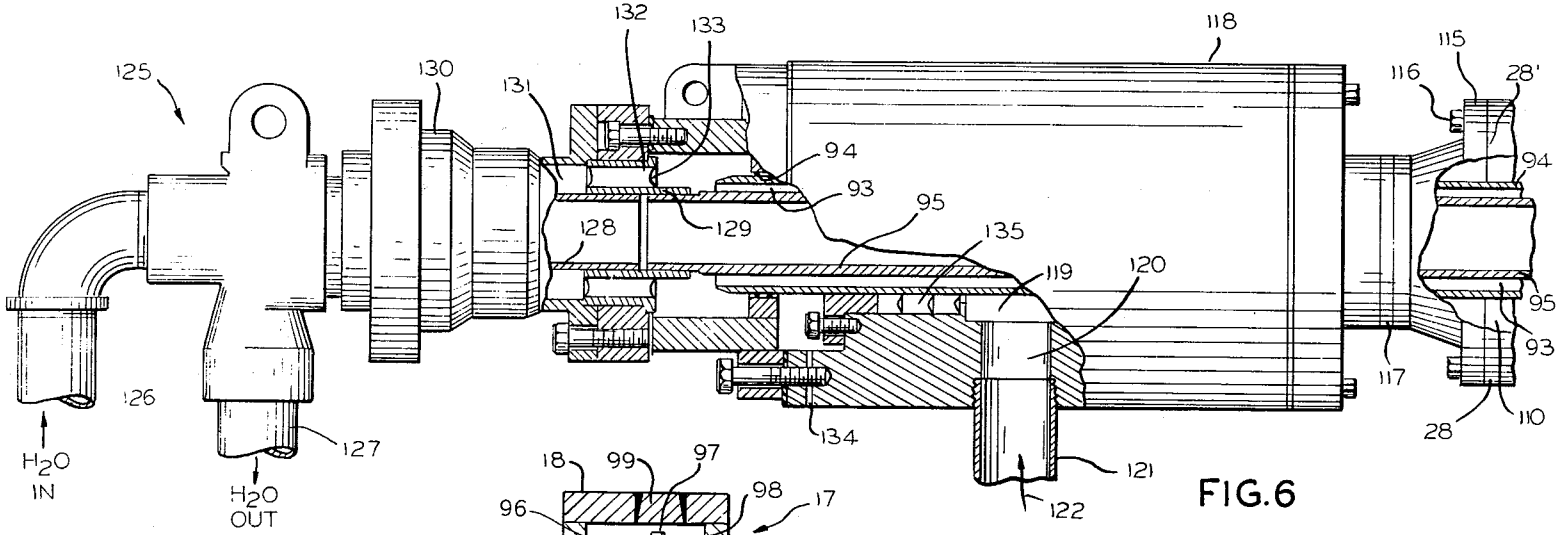
FIG. 6 is an elevation view of a rotary joint, with parts broken away, used in connection with the vessel transfer.
Figure 7:
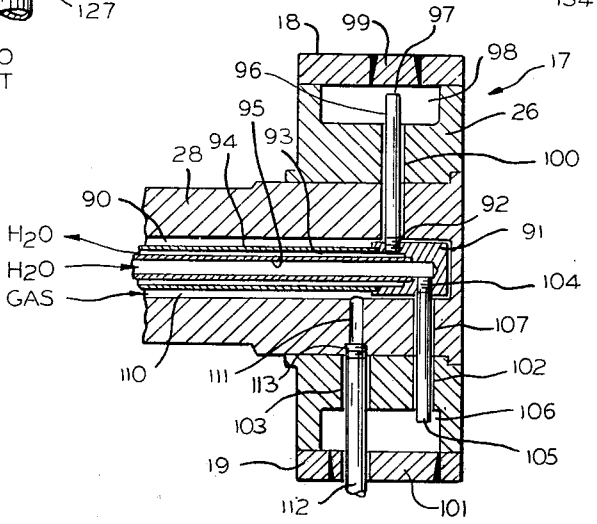
FIG. 7 is a reduced longitudinal sectional view of a portion of a vessel trunnion pin and associated trunnion rings which are treated in accordance with the invention.

FIG. 7 illustrates a typical treatment given to the drive side drive side block 26 of trunnion pin 28 and the trunnion ring 17. By using the boring machine setup of FIG. 2, an axial bore 90 is made in trunnion pin 28. The end of bore 90 is occupied by an adapter 91 which is inserted after bore 90 is made. The adapter has one radial hole 92 that opens into a gap 93 between an outer tube 94 and an inner tube 95. These latter tubes are preferably of stainless steel and so is the adapter 91. Threaded into radial adapter hole 92 is a pipe 96 which has its open end 97 in an annular cavity 98 that extends around trunnion ring 17. Pipe 96 through its opening 97 drains cooling water from cavity 97 into the annular space 93 between tubes 94 and 95 which space constitutes a cooling water outlet or return that is in communication with the rotary joint assembly which is depicted in FIG. 6 and will be described in detail later.

As explained earlier, a section or plug 99 may be removed from flange 18 of trunnion ring 17 to permit access by the boring machine spindle for making the radial bore 100 in which cooling water return pipe 96 is inserted. Finally the plug 99 is rewelded into flange 18 as shown in FIG. 7.

As is further evident in FIG. 7, a plug 101 is also burned out of trunnion ring flange 19 to permit making additional radial bores 102 and 103 in the trunnion block 26 with the boring machine setup shown in FIG. 1. Bore 102 is fitted with a pipe 107 that screws into adapter 91 at 104 and connects with the interior of internal tube 95. Tube 95 thus constitutes a cooling water inlet and incoming cooling water for the trunnion ring is discharged into a circumferential cavity 106 through the end 105 of pipe 107. The manner in which cooling water inlet cavity 106 is cross connected with cooling water outlet cavity 98 is not depicted in the drawing.

The large axial bore 90 in trunnion pin 28 serves in conjunction with the exterior of outer concentric tube 94 to create another annular or tubular axial passageway 110 which communicates with a radial bore 111 which is coaxial with bore 103 in trunnion pin 28. A pipe 112, which is shown fragmentarily, is threaded into bore 111 at 113. This pipe may be connected to pipe 54 in FIG. 4 for conducting the hydrocarbon gas to the bottom tuyeres 48 as previously discussed. The tubes 94 and 95 in FIG. 7 which extend axially through bore 90 of trunnion pin 28 also extend into a rotary joint which is depicted in FIG. 6. At its right end, the rotary joint has a flange 115 by which it is secured by means of machine screws 116 to the end face 28' of trunnion pin 28. Coaxial tubes 94 and 95 are shown broken away in FIGS. 6 and 7 and one may also see how the space between these tubes define a continuous annular passageway 93 for outflow of cooling water while cooling water flows in through tube 95. The outside wall of outer tube 94 also defines the passageway 110 through which a hydrocarbon or other gas may be delivered to vessel 10.

The rotary joint in FIG. 6 has a throat 117 which is sealed for rotation in a body 118. Thus, throat 117 rotates with trunnion pin 28 when the vessel is tilted and rotary joint body 118 remains stationary. Body 118 is broken away at about its midsection to show the ends of tubes 94 and 95. The body 118 has a large central bore 119 which connects with a radial hole 120 to which is connected a gas supply pipe 121 that connects to a pressurized source of hydrocarbon gas for instance, not shown. Gas which enters pipe 121 in the direction of arrow 122 flows through the rotary joint by way of annular passageway 119 and the communicating passageway 110 and eventually discharges through radially directed pipe 112 which is shown in FIG. 7 and is understood to lead to the bottom tuyeres 48 which are shown in FIG. 4. Sealing rings 135 are interposed between the inside bore of body 118 and the outside of tube 94 to prevent gas leakage from passageway 119. A drain hole 134 is also provided.

Coupled with body 118 in the left portion of FIG. 6 is a commercially available rotary joint 125 which connects by means of an elbow to a stationary water inlet pipe 126 and connects directly to a stationary water outlet pipe 127. The water inlet inside tube 95 in body 118 is coupled to a tube 128 by means of a coupling pin 129 which is visible in the broken away midsection. The construction of rotary joint 125 is such that coaxially connected tubes 128 and 95 may turn with trunnion pin 28 while the body of rotary joint 125 as well as pipes 126 and 127 remain stationary. Thus, axially connected pipes 128 and tube 95 can deliver cooling water continuously to the trunnion ring when vessel 10 is in any tilted position. The rotary joint 125 also has an adapter 130 which is flanged onto body 118 and has an annular opening 131 which is occupied by a perforated ring 132. The ring has axial perforations 133 for passing returning cooling water from annular passageway 93 to the water outlet pipe 127. It is understood that although the previous description covers a certain arrangement of flow, yet it is possible for other arrangements as well, by means of interchangeability of the fluids in the annular concentric paths and making the necessary connections for the exit of each fluid based on the previously described principle.

Figure 8:
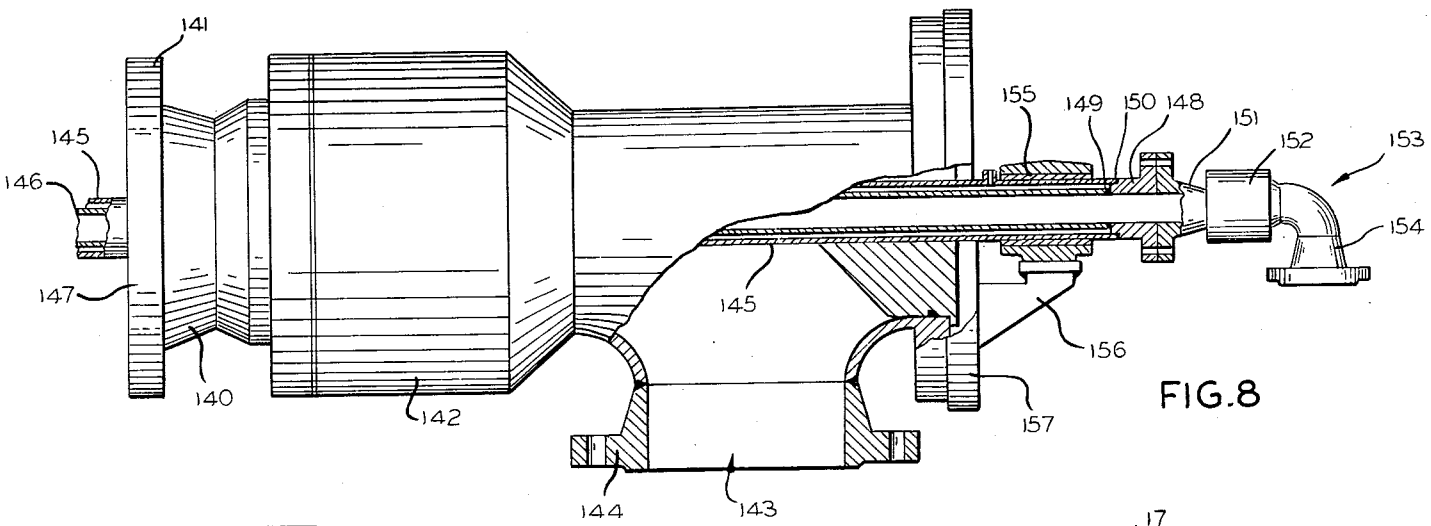
FIG. 8 represents another type of rotary joint with parts broken away and parts in section which is used on vessels that are transformed in accordance with the invention.
Figure 9:
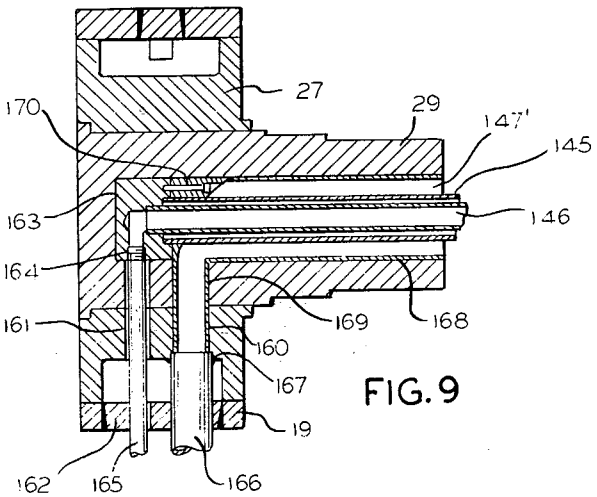
FIG. 9 is a longitudinal sectional view, reduced in size, of a vessel trunnion pin and trunnion ring which are treated in accordance with the invention.

Now that the method of typically adapting the drive side of the converter vessel 10 for bringing cooling water in and out for admitting a hydrocarbon gas through the bottom tuyeres has been described attention will be focused on FIGS. 8 and 9 which typifies treatment of the idler side of the vessel insofar as one method of transforming the vessel from a top-blown to a bottom-blown type is concerned.

FIG. 8 illustrates a type of rotary valve that can be installed on the idler side trunnion pin 29 although it should be understood that it might be installed on the drive side as well if the trunnion pin is suitably bored. The rotary valve comprises a throat 140 at the left which has a flange 141 for fastening it to the end of idler trunnion pin 29, for example, after it has been suitably bored axially and radially as suggested in FIG. 9. Flange 141, being fastened to the end of the trunnion pin, rotates with it. The rotary joint includes a body 142 which has an inlet hole 143 surrounded by a flange 144. Body 142 remains stationary while throat 140 and flange 141 rotate with the trunnion pin to which the flange 141 is attached. The large flanged opening 143 is for connecting a feed line, not shown, by which oxygen and other gases and gases entraining finely divided solids can be delivered to the rotary joint and ultimately to the center pipe 50 in the tuyeres 48 which are in the bottom of vessel 10. A pair of concentric tubes 145 and 146 extend through flange 141 and there is a hole 147 around them which constitutes an outlet for gases and finely divided materials which enter flanged side opening 143. Hole 147 communicates with bore 147' in trunnion pin 29 as can be seen in FIG. 9. Tubes 145 and 146 in FIG. 8 are understood to be continuous with their counterparts in FIG. 9.

An oxidizing gas or other gas may be delivered to vessel 10 through tube 146 in the rotary joint shown in FIG. 8. Tube 146 extends back to a flanged adapter 148 where it is joined by brazing or welding as at 149. The outer tube 145 like the inner one is preferably made of abrasion resistant stainless steel or aluminum-bronze or steel tube sprayed with aluminum-bronze or ceramic material to withstand the abrasive effect of the finely divided materials which are transported at high velocity in gas on the outside of tube 145 in the rotary joint. The rotary joint at the far right has a flanged elbow 154 for connecting it to a pipe, not shown, which would lead back to a pressurized source, not shown, of oxidizing or other gas. The concentric tubes 145 and 146 are supported in a bearing sleeve 155 which is in a bracket 156 that fastens to a flange 157. It will be evident from inspection of FIGS. 8 and 9 that central rotary tubes 145 and 146 are fastened to trunnion pin 29 and rotate with it while the rotary joint assembly 153 remains stationary. The construction is such that gas which enters rotary joint assembly 154 flows through the interior of tube 146 into the trunnion pin and ultimately to the tuyeres at the bottom of vessel 10.

A typical manner for modifying the idler side trunnion pin 29 and the trunnion block 27 to cooperate in producing fluidic material flow passageways with the rotary joint of FIG. 8 is illustrated in FIG. 9. By using the boring arrangement described in connection with FIGS. 1 and 2, the trunnion pin 29 is provided with the axial bore 147'. In this example two radial bores 160 and 161 are also made. Prior to the latter two bores being made, a plug 162 is removed from the trunnion ring flange 19 to allow the spindle of the boring machine to enter. An adapter fitting 163 is installed in the end of bore 147'. The adapter is brazed to the ends of concentric tubes 145 and 146. Adapter 163 has a threaded radial hole 164 to which a pipe such as 165 may be threadingly engaged. Pipe 165 may be connected to supply an oxidizing or other gas to the bottom tuyeres or it may be connected as necessary to pipe 176 in FIG. 10 for routing gas to the top tuyeres or elsewhere. Pipe 166 is for conducting gases and gases entraining finely divided solids to the vessel tuyeres and the pipe may be brazed or welded as at 167 into the trunnion block 27 bore 160. Thus pipe 166 communicates with the large passageway 147' in the trunnion pin. Note that axial passageway 147' and its connecting radial bore 160 have abrasion resistant stainless steel or aluminum-bronze, liners, or steel tubes sprayed with aluminum-bronze or ceramic material, to withstand abrasive effect of the finely divided materials which are transported at high velocity in the gas. A curved deflector block 170 is fixed by means of screws to adapter 163. The curved block eliminates the sharp corner which would otherwise cause flow friction and turbulence in the gas with entrained fine solids.

Figure 10:
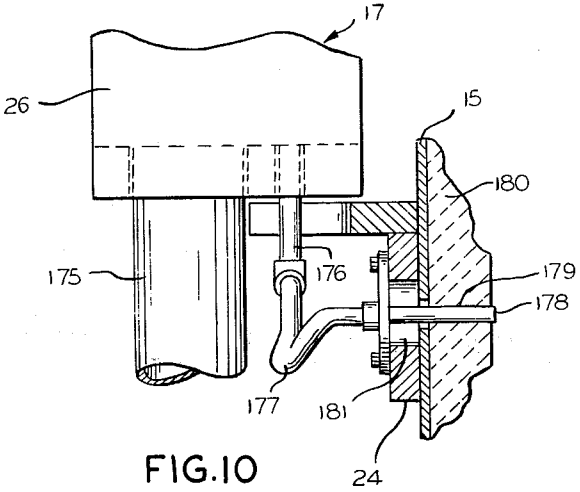
FIG. 10 is a fragment of a vessel trunnion ring from which pipes extend for conducting gas and finely divided materials entrained in gas through tuyeres of a vessel.

FIG. 10 illustrates that the trunnion pin the the surrounding trunnion block 26 may be suitably bored with the apparatus shown in FIGS. 1 and 2 to accommodate pipes which lead to the bottom tuyeres in the vessel and to sidewall tuyeres as well. For instance, the bottom tuyeres may be supplied with gas and entrained fine solids through a large pipe 175 which may connect with pipe 56 in FIG. 4. Another radially extending pipe 176 may be connected to a flexible metal hose 177 which connects with a sidewall tuyere pipe 178. The sidewall tuyere 178 extends through a hole 179 in the refractory lining 180 of vessel 10. The shell of the vessel is marked 15 in FIG. 10 to agree with FIG. 1 where the shell portion in which the sidewall tuyeres are installed is similarly marked. The sidewall tuyeres 178 may extend through an opening 181 in a bracket such as 24 which is attached to the metal shell of vessel 10. The sidewall tuyeres are preferably located above the highest expected level of molten metal within the vessel. In an actual embodiment more than one sidewall tuyere 178 may be used and they are distributed about half way around the vessel periphery and are connected to a header, not shown, which is supplied with pressurized fluidic material from pipe 176.

In summary, the foregoing description reveals how the boring apparatus shown in FIGS. 1 and 2 can be used to provide suitable passageways for enabling transformation of a top-blown vessel into a bottom-blown type. It has been shown that the vessel may be adapted for having a cooling water inlet on one side and an outlet therefor on the same side or even on the other side provided suitable rotary joints are used. It has also been shown how hydrocarbon gas inlets may be provided on either side of the vessel to supply bottom and top or sidewall tuyeres of the vessel. Various combinations of means have been described for delivering gases and gases in which finely divided solids are entrained to the vessel. From the illustrations that have been given, those skilled in the art will be able to variously modify the vessel trunnion pin and trunnion ring to effectuate transformation of a top-blown vessel to a bottom-blown type.

The true scope of the invention is to be determined by interpretation of the claims which follow.

It is claimed:

1. For metallurgical apparatus including a vessel, trunnion ring means supporting said vessel and trunnion pin means extending from said ring means to enable tilting of said vessel, at least one of said trunnion pin means having an axial bore, improved means for communicating fluids with said apparatus, comprising:

a. adapter means in said axial bore of said pin means, said adapter means having a first bore that is generally axial of said adapter means and of said pin means and also having an first generally radial bore communicating with said axial bore, and said radial bore also being in substantial registry with a generally radial hole in said pin means, b. a first tubular element extending into said axial bore of said pin means and terminating in registry with and sealably with the axial bore of said adapter means, said first tubular element being rotatable with said adapter means and with said trunnion pin means when said vessel is tilted, c. said radial hole in said pin means enabling a continuous fluid flow path through said radial hole, said adapter means and said first tubular means, d. tubular sheath means for protecting said first tubular element against erosion, said tubular sheath means surrounding said first tubular element and being sealingly joined with said adapter means so as to close the end of the space between said inner first tubular means and said tubular sheath means, e. the outside of said tubular sheath means defining with the inside of said trunnion pin axial bore a passageway for selectively transporting fluids such as gas, gas which entrains finely divided materials and coolant, f. said trunnion pin means having a hole leading generally radially from said passageway to provide a path for conducting fluid through said pin means to or from said apparatus.

2. Metallurgical apparatus including a vessel, trunnion pin means supporting said vessel to enable tilting of said vessel, one of said trunnion pin means having an axial bore, improved means for communicating fluids with said apparatus, comprising:

first and second radial openings in said trunnion pin means and communicating with said bore, adapter means disposed in said axial bore of said trunnion pin means, said adapter means having a first bore that is generally axial of said adapter means and of said pin means and a first generally radial bore communicating with said axial bore, and said first radial bore also being in substantial registry with said first radial opening in said trunnion pin means, a first tubular element extending into said axial bore of said pin means and terminating in registry with and sealably with the first axial bore of said adapter means and communicating with the first radial hole in said pin means to define a first continuous fluid flow path through said first radial hole, said adapter means and said first tubular means, said adapter means having a second generally axial bore concentric with and axially of said first axial bore, a second tubular element spaced from and surrounding said first tubular element and terminating in registry with and sealably with said second axial bore, said adapter means also having a second radial bore in substantial registry with a second generally radial opening in said pin means, said second radial bore communicating with a space defined by said second axial bore and said first tubular element which extends therethrough to define a second continuous flow path through said second radial opening, said adapter means and said second tubular means, said second tubular element being smaller than and spaced from the axial bore in said trunnion pin means to define a gap therebetween, a third radial opening is formed in said trunnion pin means and communicating with said gap to define a third continuous flow path, first pipe means coupled to one of the radial openings in said trunnion pin means and to said vessel for defining a gas flow path, said trunnion ring means having a passageway for conducting coolant fluid therein, second and third pipe means each respectively connected with said one of the other two radial openings in said trunnion pin means to the passageway in said trunnion ring means to provide a pair of coolant fluid paths between said trunnion ring passageway and two of said flow paths, said vessel having a pair of trunnion pins, said first named axial bore being formed in one of said trunnion pins, a second axial bore formed in the second one of said trunnion pins, a second adapter means in said second axial bore and having an axially spaced apart cavity, a third tubular member coupled in sealing engagement with the axial cavity of said second adapter means, said third tubular member being spaced from the axial bore in said second trunnion pin, tubular sheath means for protecting said third tubular element against erosion, said tubular sheath means surrounding said third tubular element and being sealingly joined with said second adapter means so as to close the end of the space between said third tubular means and said tubular sheath means, the outside of said tubular sheath means defining with the inside of said second trunnion pin axial bore a passageway for selectively transporting fluids such as gas which entrain finely divided materials, said second trunnion pin having a hole leading generally radially from said passageway to provide a path for conducting fluid through said pin means or from said apparatus.

* * * * *